US008325957B2

(12) United States Patent
Fischer et al.

(10) Patent No.: US 8,325,957 B2
(45) Date of Patent: Dec. 4, 2012

(54) HEARING AID AND METHOD FOR OPERATING A HEARING AID

(75) Inventors: Eghart Fischer, Schwabach (DE); Matthias Fröhlich, Erlangen (DE); Jens Hain, Kleinsendelbach (DE); Henning Puder, Erlangen (DE); Andre Steinbuss, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 880 days.

(21) Appl. No.: 12/311,630

(22) PCT Filed: Oct. 9, 2007

(86) PCT No.: PCT/EP2007/060710
§ 371 (c)(1),
(2), (4) Date: Apr. 7, 2009

(87) PCT Pub. No.: WO2008/043758
PCT Pub. Date: Apr. 17, 2008

(65) Prior Publication Data

US 2010/0027821 A1 Feb. 4, 2010

(30) Foreign Application Priority Data

Oct. 10, 2006 (DE) ..... 10 2006 047 985

(51) Int. Cl.
*H04R 25/00* (2006.01)

(52) U.S. Cl. ..... 381/317; 381/312; 381/313; 381/318

(58) Field of Classification Search ..... 381/312, 381/313, 317, 318
See application file for complete search history.

(56) References Cited

U.S. PATENT DOCUMENTS

| | | | |
|---|---|---|---|
| 2003/0185411 | A1 | 10/2003 | Atlas et al. |
| 2007/0030982 | A1 | 2/2007 | Jones et al. |

FOREIGN PATENT DOCUMENTS

| | | | |
|---|---|---|---|
| EP | 1017253 | A2 | 7/2000 |
| EP | 1432282 | A2 | 6/2004 |
| EP | 1655998 | A2 | 5/2006 |
| EP | 1670285 | A2 | 6/2006 |
| JP | 9033329 | A | 2/1997 |
| JP | 2000066698 | A | 3/2000 |

(Continued)

OTHER PUBLICATIONS

Communication from Japanese Patent Office listing cited references, Dec. 22, 2011, pp. 1-5, 1-8.

*Primary Examiner* — Matthew E Warren
*Assistant Examiner* — John Lin

(57) ABSTRACT

The invention relates to a method for a hearing aid wearer to actively operate a hearing aid. A signal processing section of the hearing aid has a demixing module for separating audio signals and a postprocessor module which sets up a hold mode of operation for the hearing aid. An audio signal, which is preferred by the hearing aid wearer, from an ambient sound, is tracked and selected by virtue of the hearing aid wearer transmitting to the hearing aid a command which sets up the hold mode of operation in the signal processing section of the hearing aid for a certain period. The signal processing section tracks the preferred audio signal and selectively takes account of it in an output sound from the hearing aid such that it is audibly highlighted for the hearing aid wearer in comparison with another audio signal and is thereby perceived better.

20 Claims, 3 Drawing Sheets

FOREIGN PATENT DOCUMENTS

| | | | |
|---|---|---|---|
| JP | 2003533152 | A | 11/2003 |
| JP | 2004512493 | A | 4/2004 |
| JP | 2005268964 | A | 9/2005 |
| JP | 2006178333 | A | 7/2006 |
| WO | WO 0187011 | A2 | 11/2001 |

HEARING AID AND METHOD FOR OPERATING A HEARING AID

CROSS REFERENCE TO RELATED APPLICATIONS

This application is the US National Stage of International Application No. PCT/EP2007/060710, filed Oct. 9, 2007 and claims the benefit thereof. The International Application claims the benefits of German application No. 10 2006 047 985.8 filed Oct. 10, 2006, both of the applications are incorporated by reference herein in their entirety.

FIELD OF THE INVENTION

The invention relates to a method for actively operating a hearing aid consisting of a single hearing device or two hearing devices. The invention also relates to a corresponding hearing aid or hearing device.

BACKGROUND OF THE INVENTION

When one is listening to someone or something, disturbing noise or unwanted acoustic signals are present everywhere that interfere with the other person's voice or with a wanted acoustic signal. People with a hearing impairment are especially susceptible to such noise interference. Background conversations, acoustic disturbance from digital devices (cell phones), traffic or other environmental noise can make it very difficult for a hearing-impaired person to understand the speaker they want to listen to. Reducing the noise level in an acoustic signal, combined with automatic focusing on a wanted acoustic signal component, can significantly improve the efficiency of an electronic speech processor of the type used in modern hearing aids.

Hearing aids employing digital signal processing have recently been introduced. They contain one or more microphones, A/D converters, digital signal processors, and loudspeakers. The digital signal processors usually subdivide the incoming signals into a plurality of frequency bands. Within each of these bands, signal amplification and processing can be individually matched to the requirements of a particular hearing aid wearer in order to improve the intelligibility of a particular component. Also available in connection with digital signal processing are algorithms for minimizing feedback and interference noise, although these have significant disadvantages. The disadvantageous feature of the algorithms currently employed for minimizing interference noise is, for example, the maximum improvement they can achieve in hearing-aid acoustics when speech and background noise are within the same frequency region, making them incapable of distinguishing between spoken language and background noise. (See also EP 1 017 253 A2).

This is one of the most frequently occurring problems in acoustic signal processing, namely extracting one or more acoustic signals from different overlapping acoustic signals. It is also known as the "cocktail party problem", wherein all manner of different sounds such as music and conversations merge into an indefinable acoustic backdrop. Nevertheless, people generally do not find it difficult to hold a conversation in such a situation. It is therefore desirable for hearing aid wearers to be able to converse in just such situations in the same way as people without a hearing impairment.

EP 1 432 282 A2 discloses a digital method for adjusting a hearing program of a hearing device to an instantaneous acoustic ambient situation, and a hearing device system for this purpose. With this method, in a digital signal analysis unit of the hearing device, characteristic auditory-based features are extracted from a digital acoustic signal and analyzed by a pattern recognizer in a signal identification unit to determine an acoustic ambient situation and generate a corresponding acoustic output signal. Said acoustic output signal is fed to a transmission unit that can be manipulated by an input unit such as a remote control, it being possible for preset parameter sets of the transmission unit to be influenced by a hearing aid wearer's input unit.

In acoustic signal processing there exist spatial (e.g. directional microphone, beam forming), statistical (e.g. blind source separation), and hybrid methods which, by means of algorithms and otherwise, are able to separate out one or more sound sources from a plurality of simultaneously active sound sources. For example, by means of statistical signal processing of at least two microphone signals, blind source separation enables source signals to be separated without prior knowledge of their geometric arrangement. When applied to hearing aids, that method has advantages over conventional approaches involving a directional microphone. Using a BSS (Blind Source Separation) method of this kind it is inherently possible, with n microphones, to separate up to n sources, i.e. to generate n output signals.

Known from the relevant literature are blind source separation methods wherein sound sources are analyzed by analyzing at least two microphone signals. A method and corresponding device of this kind are known from EP 1 017 253 A2, the scope of whose disclosure is expressly to be included in the present specification. Corresponding points of linkage between the invention and EP 1 017 253 A2 are indicated mainly at the end of the present specification.

In a specific application for blind source separation in hearing aids, this requires communication between two hearing devices (analysis of at least two microphone signals (right/left)) and preferably binaural evaluation of the signals of the two hearing devices which is preferably performed wirelessly. Alternative couplings of the two hearing devices are also possible in such an application. Binaural evaluation of this kind with stereo signals being provided for a hearing aid wearer is taught in EP 1 655 998 A2, the scope of whose disclosure is likewise to be included in the present specification. Corresponding points of linkage between the invention and EP 1 655 998 A2 are indicated at the end of the present specification.

Directional microphone control in the context of blind source separation is subject to ambiguity once a plurality of competing wanted sources, e.g. speakers, are simultaneously present. While blind source separation basically allows the different sources to be separated, provided they are spatially separate, the potential benefit of a directional microphone is reduced by said ambiguity problems, although a directional microphone can be of great benefit in improving speech intelligibility specifically in such scenarios.

The hearing aid or more particularly the mathematical algorithms for blind source separation is/are basically faced with the dilemma of having to decide which of the signals produced by blind source separation can be most advantageously forwarded to the algorithm user, i.e. the hearing aid wearer. This is basically an unresolvable problem for the hearing aid because the choice of wanted acoustic source will depend directly on the hearing aid wearer's momentary intention and hence cannot be available to a selection algorithm as an input variable. The selection made by said algorithm must accordingly be based on assumptions about the listener's likely intention.

The prior art is based on the assumption that the hearing aid wearer prefers an acoustic signal from a 0° direction, i.e. from the direction in which the hearing aid wearer is looking. This is realistic insofar as, in an acoustically difficult situation, the hearing aid wearer would look at his/her current interlocutor to obtain further cues (e.g. lip movements) for increasing said interlocutor's speech intelligibility. This means that the hearing aid wearer is compelled to look at his/her interlocutor so that the directional microphone will produce increased speech intelligibility. This is annoying particularly when the hearing aid wearer wants to converse with just one person, i.e. is not involved in communicating with a plurality of speakers, and does not always wish/have to look at his/her interlocutor.

If the direction of the wanted sound is not set to 0° for the hearing aid, ambiguity can be resolved by other additional information, e.g. by giving preference to the acoustic signal arriving with an angle of incidence that is as small as possible with respect to the forward direction. However, this severely restricts the hearing aid wearer's freedom of movement. It also creates the potential problem of 'jumping' between different speakers, which is unintended and experienced as unpleasant by the hearing aid wearer.

Furthermore, there is to date no known technical method for making a "correct" choice of acoustic source, or more specifically one preferred by the hearing aid wearer, after source separation has taken place.

SUMMARY OF THE INVENTION

An object of the invention is to specify an improved method for operating a hearing aid, and an improved hearing aid. In particular, an object of the invention is to determine which of the electrical output signals resulting from source separation, in particular blind source separation, is fed to the hearing aid wearer. It is therefore an object of the invention to discover which signal is, with a high degree of probability, the hearing aid wearer's preferred sound source.

The object of the invention is achieved by a method for operating a hearing aid and by a hearing aid as claimed in the claims.

Instead of leaving it up to the hearing aid to decide which of the output signals resulting from source separation is selected, i.e. compelling a hearing aid wearer to behave in a particular way, the object of the invention is achieved to the effect that this decision is left up to the hearing aid wearer him/herself.

According to the invention, a method for the active operation of a hearing aid by a hearing aid wearer is provided wherein, for tracking and selectively amplifying the hearing aid wearer's preferred acoustic signal, a "hold" command is transmitted to a signal processing section of the hearing aid which instructs the signal processing section to track said acoustic signal selected by the hearing aid wearer and to take it particularly into account in an acoustic output signal of the hearing aid.

Additionally provided according to the invention is a hearing aid with an input device, said input device being invokable and/or actuatable by a hearing aid wearer in order to actively give an instruction to the hearing aid in such a way that a "hold" command can be given by the input device to an acoustic module (signal processing section) of the hearing aid which identifies the hearing aid wearer's preferred acoustic signal which can be particularly taken into account in an output sound of the hearing aid.

The selection as to which acoustic signal or more specifically which speaker is to be tracked is made in a simple and intuitive manner by the user of the hearing aid in order to avoid the essential ambiguity of source separation methods. The hearing aid wearer knows best with whom he/she currently wishes to speak, so that no mis-classification of the preferred acoustic signal by automatic processes inside the hearing aid occurs. He/she is not restricted in his/her freedom of movement, except when executing the "hold" command, and benefits from the automatic directional microphone in an acoustically difficult situation in which a directional microphone can be extremely useful to him/her in terms of speech intelligibility.

It is inventively possible, depending on the number of microphones present in the hearing aid, to select one or more hearing aid wearer preferred acoustic signals from the ambient sound and accentuate them in the hearing aid's output sound, it being possible here to adjust a volume of the preferred acoustic signal or signals in the output sound as required.

In a preferred embodiment of the invention, the signal processing section has an unmixer module that preferably operates as a blind source separation device for separating the acoustic signals within the ambient sound. The signal processing section also has a post-processor module which, in response to the "hold" command, sets up the corresponding operating mode in the hearing aid. The signal processing section can also have a pre-processor module—the electrical output signals of which are the unmixer module's electrical input signals—which standardizes and conditions electrical signals originating from microphones of the hearing aid. In respect of the pre-processor module and unmixer module, reference is made to EP 1 017 253 A2 paragraphs [0008] to [0023].

When he/she wishes to have a particular acoustic signal tracked by the hearing aid's microphones, the hearing aid wearer enters, via the input device, the "hold" command to the signal processing section which selects the corresponding signal or signals in the post-processor module and makes it/them available to a loudspeaker of a receiver of the hearing aid at least louder than other, unwanted acoustic signals.

The input device can be any device or apparatus on the hearing aid or on a remote control for the hearing aid. In its simplest embodiment, it is a control on the hearing aid and/or remote control. However, it is likewise possible for the input device to be embodied as voice-actuated control in the hearing aid or remote control. The acoustic signal that is loudest or predominant in the ambient sound when the "hold" command is executed and/or which is preferably coming from a 0° viewing direction of the hearing aid wearer is then tracked by the source separation algorithm, preferably the BSS algorithm, and made available to the wearer in accentuated form through the receiver of the hearing aid.

According to the invention, either "simple tracking" of the preferred acoustic signal is possible in which a speaker is tracked for as long as he/she is speaking, i.e. without a memory function. Preferable, however, is so-called "intelligent tracking" whereby one or more preferred acoustic signals are analyzed and temporarily stored in the hearing aid in the form of characteristic parameters (speaker recognition). This inventively makes it possible for the speaker to be tracked by the hearing aid or more specifically the signal processing section during a genuine dialog, i.e. one in which the hearing aid wearer is speaking now and then and his/her interlocutor is silent.

Once such a "hold" operating mode is set up for a single preferred acoustic signal or the "hold" operating modes are set up for a plurality of preferred acoustic signals, its/their tracking is independent of the hearing aid wearer's head movement or viewing direction.

Further tracking of the preferred acoustic signal or signals can be inventively terminated by a release command to the input device. If a plurality of preferred acoustic signals are selected by the hearing aid wearer, it is possible here to release the preferred acoustic signal that is the loudest or predominant when the release command is executed, or preferably to release the preferred acoustic signal coming from the current 0° viewing direction of the hearing aid wearer. Independently of this, it is also possible to release any hitherto preferred acoustic signal, as the latter has already been identified. If only a single preferred acoustic signal is selected, this can naturally be dispensed with.

In addition, further tracking of the preferred acoustic signal or signals can be terminated by a time criterion (timeout) if one of the speakers or the speaker has no longer been detected for a particular time period by the hearing aid's speaker recognition system. The length of time for which the hearing aid is unintentionally left in "hold" mode can be reduced by an automatically generated release command, i.e. an automatic timeout.

Additional preferred embodiments of the invention will emerge from the other dependent claims.

BRIEF DESCRIPTION OF THE DRAWINGS

The invention will now be explained in greater detail on the basis of exemplary embodiments and with reference to the accompanying drawings in which.

DETAILED DESCRIPTION OF THE INVENTION

Within the scope of the invention (FIGS. 2 & 3), the following description mainly relates to a BSS (blind source separation) module. However, the invention is not limited to blind source separation of this kind but is intended broadly to encompass source separation methods for acoustic signals in general. Said BSS module is therefore also referred to as an unmixer module.

The following description also discusses "tracking" of a preferred acoustic signal by a hearing aid wearer's hearing aid. This is to be understood as a selection made by the hearing aid wearer of one or more acoustic signals that are electrically or electronically selected by the hearing aid from other acoustic signals in the ambient sound and which are reproduced in an amplified manner compared to the other acoustic signals in the ambient sound, i.e. in a manner experienced as louder for the hearing aid wearer. For tracking of the preferred acoustic signal by the hearing aid, advantageously no account is taken of the hearing aid wearer's position in space, in particular of the hearing aid's position in space, i.e. the direction in which the hearing aid wearer is looking.

Figure 1:
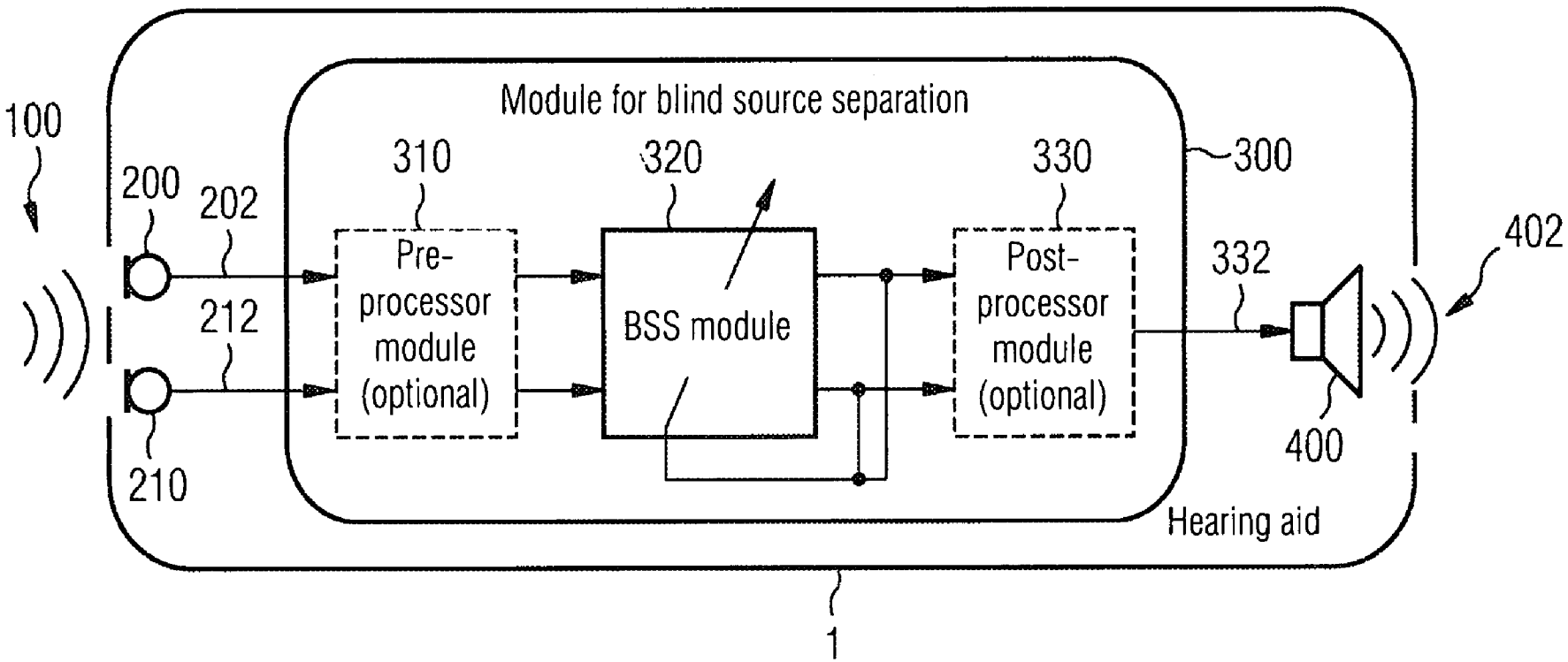
FIG 1 Prior art
FIG. 1 shows a block diagram of a hearing aid according to the prior art, having a module for blind source separation.

FIG. 1 shows the prior art as taught in EP 1 017 253 A2 (as to which see paragraph [0008] et seq.). Here a hearing aid 1 has two microphones 200, 210, which can together constitute a directional microphone system, for generating two electrical output signals 202, 212. A microphone arrangement of this kind gives the two electrical output signals 202, 212 of the microphones 200, 210 an inherent directional characteristic. Each of the microphones 200, 210 picks up an ambient sound 100 which is a mixture of unknown acoustic signals from an unknown number of acoustic sources.

In the prior art, the microphone signals 202, 212 are mainly conditioned in three stages. In a first stage, the microphone signals 202, 212 are pre-processed in a pre-processor module 310 to improve the directional characteristic, starting with standardization of the original signals (equalizing the signal strength). In a second stage, blind source separation takes place in a BSS module 320, the output signals of the pre-processor module 310 undergoing an unmixing process. The output signals of the BSS module 320 are then post-processed in a post-processor module 330 in order to generate a desired electrical output signal 332 which is used as an input signal for a receiver 400, or more specifically for a loudspeaker 400 of the hearing aid 1, and to deliver a sound generated thereby to the hearing aid wearer. As specified in EP 1 017 253 A2, steps 1 and 3, i.e. the pre-processor module 310 and post-processor module 330, are optional.

Figure 2:
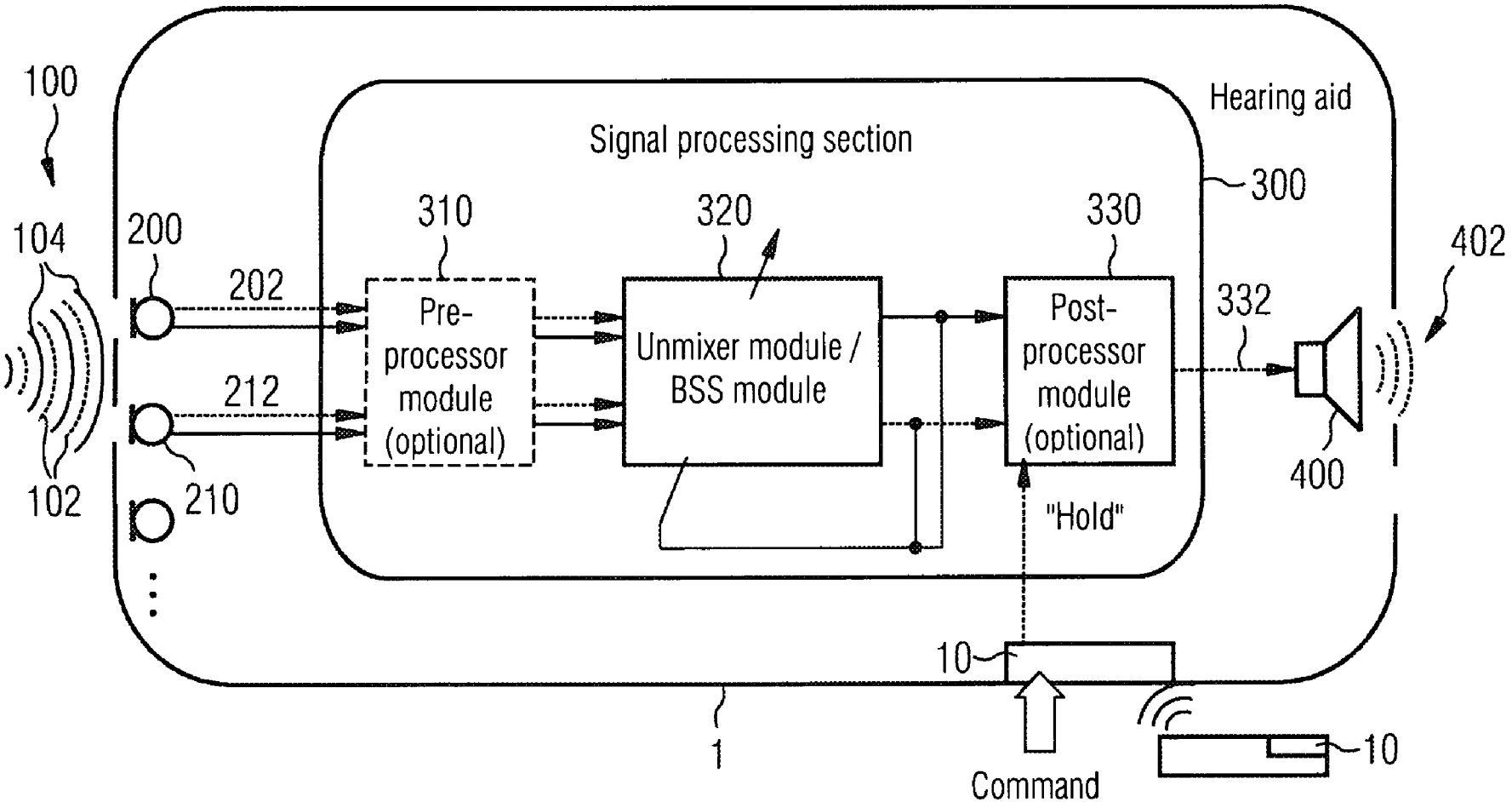
FIG. 2 shows a block diagram of a hearing aid according to the invention, having an inventive signal processing section controllable by the hearing aid wearer for processing an ambient sound containing two acoustically independent signal sources.

FIG. 2 now shows a first embodiment of the invention wherein a signal processing section 300 of the hearing aid 1 contains an unmixer module 320, hereinafter referred to as a BSS module 320, connected downstream of which is a post-processor module 330. A pre-processor module 310 which appropriately conditions i.e. prepares the input signals for the BSS module 320 can again be provided here. Signal processing 300 is preferably carried out in a DSP (Digital Signal Processor) or an ASIC (Application Specific Integrated Circuit).

It shall be assumed in the following that there are two acoustically independent signals 102, 104, i.e. signal sources 102, 104, in the ambient sound 100, one of said acoustic signals 102 being the acoustic signal 102 preferred by the hearing aid wearer. This preferred acoustic signal 102 is to be tracked by the hearing aid 1 or more specifically the signal processing section 300 and is to be a main acoustic component of the receiver 400 so that an output sound 402 of the loudspeaker 400 mainly contains said signal (102).

The two microphones 200, 210 of the hearing aid 1 each pick up a mixture of the two acoustic signals 102, 104—indicated by the dotted arrow (representing the preferred acoustic signal 102) and by the continuous arrow (representing the non-preferred acoustic signal 104)—and deliver them either to the pre-processor module 310 or immediately to the BSS module 320 as electrical input signals. The two microphones 200, 210 can be arranged in any manner. They can be located in a single hearing device 1 of the hearing aid 1 or distributed over both hearing devices 1. It is also possible, for instance, to provide one or both microphones 200, 210 outside the hearing aid 1, e.g. on a collar or in a pin, as long as it is still possible to communicate with the hearing aid 1. This also means that the electrical input signals of the BSS module 320 do not necessarily have to originate from a single hearing device 1 of the hearing aid 1. It is, of course, possible to implement more than two microphones 200, 210 for a hearing aid 1. A hearing aid 1 consisting of two hearing devices 1 preferably has a total of four or six microphones.

The pre-processor module 310 conditions the data for the BSS module 320 which, depending on its capability, for its part forms two separate output signals from its two, in each case mixed input signals, each of said output signals representing one of the two acoustic signals 102, 104. The two separate output signals of the BSS module 320 are input signals for the post-processor module 330 in which it is then decided which of the two acoustic signals 102, 104 will be fed out to the loudspeaker 400 as an electrical output signal 332.

For this purpose the hearing aid wearer inventively issues an appropriate command to the signal processing section 300 or more specifically the post-processor module 330, a "hold" operating mode being established for the hearing aid 1 for a particular time T by an input device 10 on or in the hearing aid 1 or by a remote control (schematically shown at bottom right in FIG. 2). Said "hold" operating mode represents one of the two output signals of the BSS module 320. In the present example in FIG. 2 this is illustrated by the dotted arrow which represents the hearing aid wearer's preferred acoustic signal 102. The post-processor module 330 is now set up such that it delivers a representative of the preferred acoustic signal 102 in an amplified manner to the receiver 400 of the hearing aid 1.

The input device 10 can be e.g. a button 10 or a switch 10 on the hearing device 1 or on the remote control of the hearing device. It is additionally possible for the input device 10 to be embodied as a speaker recognition module in the hearing device 1 or remote control or as a voice-actuated control.

If the input device 10 is actuated, the post-processor module 330 establishes the "hold" operating mode which mainly produces the preferred acoustic signal 102 as the electrical output signal 332 of the hearing aid 1 over a particular time T. In so doing, e.g. the source signal mainly coming from the hearing aid wearer's 0° viewing direction when the input device 10 is actuated can be selected from the ambient sound 100. Other angles are also possible here. It is also possible, when the input device 10 is actuated or invoked, for the predominant or loudest signal in the ambient sound 100 to be tracked in "hold" mode. It is additionally possible for the corresponding hearing aid wearer preferred acoustic signal 102 to be identified in terms of its frequency range or more specifically its respective frequency extremes, its pitch or octave range, by a particular human voice, by music, by a particular absence of interference or by timewise similar spacings of mutually similar acoustic events or by the opposite of the above. For selecting the preferred acoustic signal 102, the acoustic signal 102 coming from the hearing aid wearer's 0° viewing direction is given preference and then tracked by the algorithm of the BSS module 320 or more specifically the post-processor module 330.

Tracking of the preferred acoustic signal 102 continues until such time as the hearing aid wearer issues a release command via the input device 10 or a speaker (corresponding to the preferred acoustic signal 102) is tracked for as long as he/she is speaking. In addition, a speaker signal 102 can be temporarily stored by a speech analyzer in the form of characteristic parameters in the signal processing section 300 or the hearing aid 1 and is tracked independently of any head movement or viewing direction of the hearing aid wearer. In the latter situation, the speaker is released either by the hearing aid wearer's release command or via a timeout.

Figure 3:
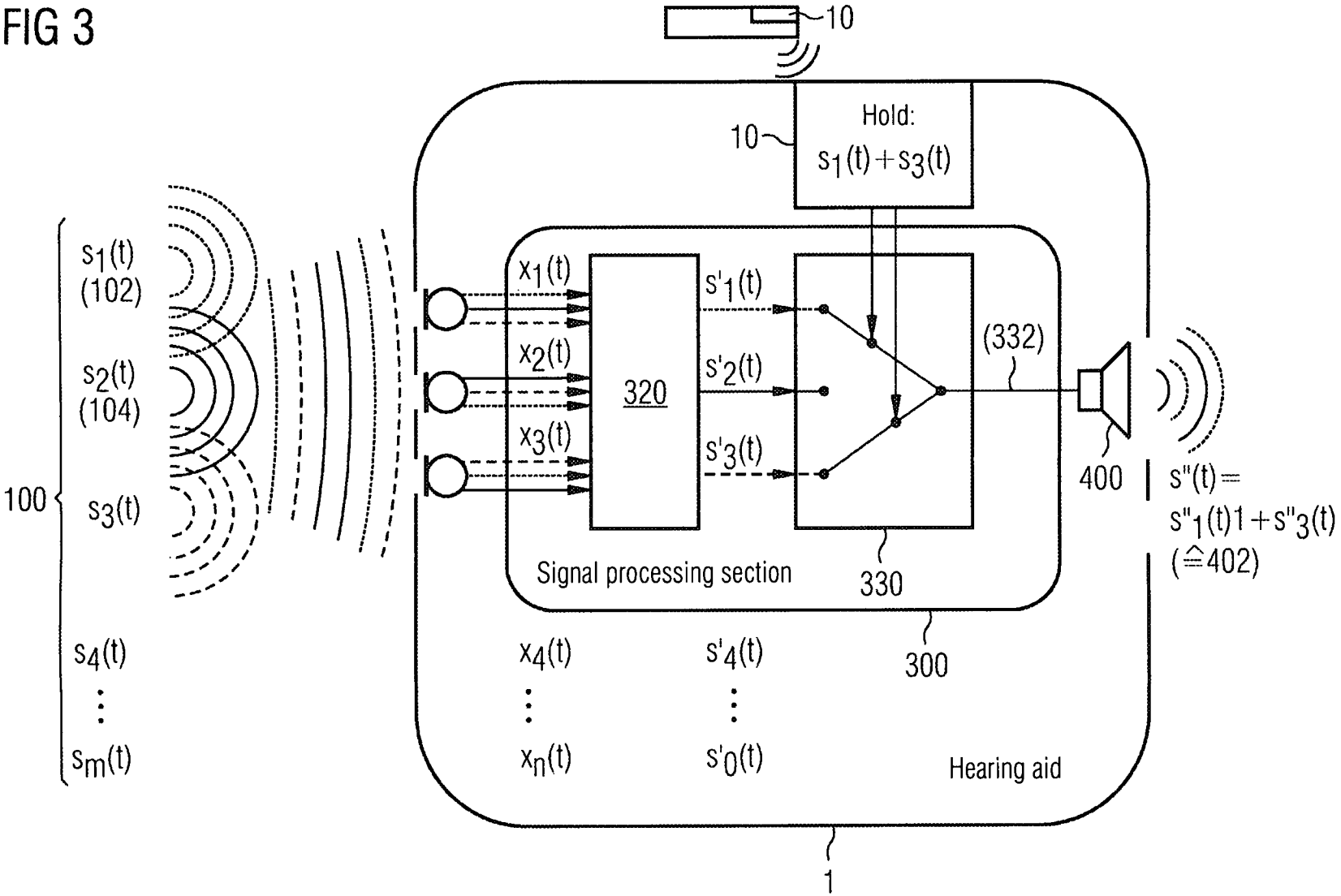
FIG. 3 shows a block diagram of a second embodiment of the inventive hearing aid hearing aid for simultaneously processing three acoustically independent signal sources in the ambient sound.

FIG. 3 shows the inventive method and the inventive hearing aid 1 for processing three acoustic signal sources $s_1(t)$, $s_2(t)$, $s_3(t)$ which, in combination, constitute the ambient sound 100. Said ambient sound 100 is picked up in each case by three microphones which each feed out an electrical microphone signal $x_1(t)$, $x_2(t)$, $x_3(t)$ to the signal processing section 300. Although the signal processing section 300 has no pre-processor module 310, it can preferably contain one (this applies analogously also to the first embodiment of the invention). It is, of course, also possible to process m acoustic sources s in parallel via n microphones x, which is indicated by the items $s_4(t), \ldots, s_m(t)$ and $x_4(t), \ldots, x_n(t)$ respectively in FIG. 3.

The electrical microphone signals $x_1(t)$, $x_2(t)$, $x_3(t)$ are input signals for the BSS module 320 which separates the acoustic signals $s_1(t)$, $s_2(t)$, $s_3(t)$ respectively contained in the microphone signals $x_1(t)$, $x_2(t)$, $x_3(t)$ according to acoustic sources and feeds them out as electrical output signals $s'_1(t)$, $s'_2(t)$, $s'_3(t)$ [analogously: $s'_4(t), \ldots, s'_o(t)$] to the post-processor module 330.

In the following, the hearing aid wearer prefers two acoustic signals, namely $s_1(t)$ and $s_3(t)$ (this corresponds most closely to the acoustic sources $s_1(t)$ and $s_3(t)$). Here the hearing aid wearer successively enters the corresponding "hold" command to the input device 10 to establish the "hold" operating mode (see above), the post-processor module 330 selecting the corresponding output signals $s'_1(t)$, $s'_3(t)$ of the BSS module 320 and delivering them amplified through the receiver 400 as output sound 402, $s''(t)=s''_1(t)+s''_2(t)$. Identification of the acoustic sources $s_1(t)$ and $s_3(t)$ takes place as described above.

It is additionally possible to "scan" the output signals $s'_1(t)$, $s'_2(t)$, $s'_3(t)$ of the BSS module 320 by means of the input device 10 and then make an appropriate selection.

In this embodiment of the invention it is self-evidently also possible to reproduce one or three or more preferred acoustic signals in an amplified manner.

The present specification relates inter alia to a post-processor module 20 as in EP 1 017 253 A2 which can be controlled by a hearing aid wearer via an input device (the reference numerals are those given in EP 1 017 253 A2). See also in that regard paragraph [0025] in EP 1 017 253 A2. In the invention, the pre-processor module and the BSS module can moreover be of the same design as the pre-processor 16 and the unmixer 18 in EP 1 017 253 A2. See in particular paragraphs [0008] to [0024] in EP 1 017 253 A2.

The invention also links to EP 1 655 998 A2 in providing a hearing aid wearer with stereo signals for an acoustic source selected by him/her or rather enabling a hearing aid wearer to be supplied in a binaural acoustic manner, the invention (notation according to EP 1 655 998 A2) preferably being connected downstream of the output signals z1, z2 for the right(k) and left(k) respectively of a second filter device in EP 1 655 998 A2 (see FIGS. 2 and 3) for accentuating/amplifying the corresponding acoustic source. In addition, it is also possible to apply the invention in the case of EP 1 655 998 A2 to the effect that it will come into play after the blind source separation disclosed therein and ahead of the second filter device, i.e. selection of a signal y1(k), y2(k) inventively taking place (see FIG. 3 in EP 1 655 998 A2).

The invention claimed is:

1. A method for actively operating a hearing aid by a hearing aid wearer, comprising:

separating acoustic signals in an ambient sound by an unmixer module in a signal processing section;

communicating a command to the hearing aid by the hearing aid wearer to establish a hold operating mode for a time duration;

establishing the hold operating mode for the time duration by a post-processor module in the signal processing section;

selecting and tracking a hearing aid wearer preferred acoustic signal from the separated acoustic signals in the ambient sound in the hold operating mode; and outputting the hearing aid wearer preferred acoustic signal in an output sound of the hearing aid so that the hearing aid wearer preferred acoustic signal is acoustically prominent and better perceived by the hearing aid wearer compared to other acoustic signals in the ambient sound.

2. The method as claimed in claim 1, wherein the unmixer module is a blind source separation module.

3. The method as claimed in claim 1, wherein the ambient sound comprises a plurality of acoustically independent hearing aid wearer preferred acoustic that are tracked separately from one another by the signal processing section.

4. The method as claimed in claim 1, wherein the hearing aid wearer preferred acoustic signal comes from a particular direction with respect to the hearing aid wearer and is tracked by the signal processing section, and wherein the particular direction is a 0° viewing direction with respect to the hearing aid.

5. The method as claimed in claim 1, wherein an acoustic signal that is predominant in the ambient sound is tracked as the hearing aid wearer preferred acoustic signal.

6. The method as claimed in claim 1, wherein the hearing aid wearer preferred acoustic signal is characterized by a characteristic parameter in the signal processing section.

7. The method as claimed in claim 6, wherein the characteristic parameter is selected from the group consisting of: volume in the ambient sound, frequency range, frequency extreme, pitch, octave range, particular human voice, music, maximum lack of interference, and timewise similar spacing of mutually similar acoustic event.

8. The method as claimed in claim 1, wherein only the hearing aid wearer preferred acoustic signal from the ambient sound is perceived by the hearing aid wearer in the output sound of the hearing aid in the hold operating mode for the time duration.

9. The method as claimed in claim 1, wherein the hearing aid wearer preferred acoustic signal is tracked until the hearing aid wearer preferred acoustic signal becomes silent or a brief revival of the hearing aid wearer preferred acoustic signal does not happen for a particular period of time.

10. The method as claimed in claim 1, wherein the hearing aid wearer preferred acoustic signal is temporarily stored by the hearing aid and is tracked again when the hearing aid wearer preferred acoustic signal revives.

11. The method as claimed in claim 1, wherein the hearing aid wearer preferred acoustic signal is tracked until a particular point in time after the hearing aid wearer preferred acoustic signal has become silent.

12. The method as claimed in claim 1, wherein the hearing aid wearer preferred acoustic signal is tracked until a command to release the hold mode is communicated to the hearing aid by the hearing aid wearer.

13. The method as claimed in claim 12, wherein the command to establish the hold mode and the command to release the hold mode is initiated by the hearing aid wearer using an input device.

14. The method as claimed in claim 13, wherein the input device is a control on the hearing aid or a control on a remote control of the hearing aid, and wherein the control is a button, a switch, or a voice-actuated control with an assigned speaker recognition module of the hearing aid which is attuned to the hearing aid wearer's voice.

15. The method as claimed in claim 1, wherein a volume matching of the separated acoustic signals is performed in the post-processor module.

16. The method as claimed in claim 1, wherein the acoustic signals are conditioned for the unmixer module by a preprocessor module in the signal processing section.

17. A hearing aid, comprising:

a microphone that receives acoustic signals in a ambient sound;

an input device by which a wearer of the hearing aid inputs a command for establishing a hold operating mode for a time duration; and a signal processing section that:

separates the acoustic signals by an unmixer module, establishes the hold operating mode by a post-processor module, identifies a hearing aid wearer preferred acoustic signal in the ambient sound in the hold operating mode, and outputs the hearing aid wearer preferred acoustic signal in an output sound of the hearing aid so that the hearing aid wearer preferred acoustic signal is amplified and better perceived by the hearing aid wearer compared to other acoustic signals in the ambient sound.

18. The hearing aid as claimed in claim 17, wherein the signal processing section tracks and selects the hearing aid wearer preferred acoustic signal and generates a corresponding electrical output signal in the output sound for a receiver of the hearing aid.

19. The hearing aid as claimed in claim 17, wherein the hearing aid comprises a plurality of microphones that receive the ambient sound and each of the microphones feeds out an electrical output signal to the signal processing section.

20. The hearing aid as claimed in claim 17, wherein the hearing aid comprises one or two hearing devices.

* * * * *